US005980579A

United States Patent [19]

Yoon

[11] Patent Number: 5,980,579

[45] Date of Patent: Nov. 9, 1999

[54] PROCESS FOR IMPROVED SHRINK RESISTANCE IN WOOL

[75] Inventor: Mee-Young Yoon, Palo Alto, Calif.

[73] Assignee: Genencor International, Inc., Rochester, N.Y.

[21] Appl. No.: 08/768,872

[22] Filed: Dec. 17, 1996

[51] Int. Cl.[6] ..... D06M 16/00

[52] U.S. Cl. ..... 8/128.1; 8/401; 8/107; 8/111; 8/112; 8/128.3; 435/262; 435/263

[58] Field of Search ..... 8/401, 107, 111, 8/128.1, 128.3, 112; 435/263, 262

[56] References Cited

U.S. PATENT DOCUMENTS 5,529,928 6/1996 Ciampi et al. ..... 8/112

FOREIGN PATENT DOCUMENTS 0 358 386 A2 8/1989 European Pat. Off. .

2 694 018 7/1992 France .

804 781 11/1958 United Kingdom .

WO 89/03909 5/1989 WIPO .

WO 94/12621 6/1994 WIPO .

WO 95/01426 1/1995 WIPO .

OTHER PUBLICATIONS

Chemical Abstract No. 120:301005, Jun. 1994.

*Primary Examiner*—Alan Diamond

*Attorney, Agent, or Firm*—Christopher L. Stone

[57] ABSTRACT

A method is provided for reducing the shrinkage of wool comprising the steps of: (a) preparing an aqueous solution comprising an oxidase or a peroxidase; and (b) contacting a wool containing article with said aqueous solution under conditions suitable for reacting said oxidase or peroxidase with said wool.

12 Claims, 1 Drawing Sheet

PROCESS FOR IMPROVED SHRINK RESISTANCE IN WOOL

BACKGROUND OF THE INVENTION

1. Field of the Invention

The present invention is directed to methods for reducing the shrinkage of wool during a wetting and/or laundering stage. More particularly, the present invention provides for a method of reducing the shrinkage of wool during wet processing by contacting the wool substrate with an oxidoreductase enzyme.

2. State of the Art

The conversion of raw wool into a textile fabric or garment involves a long series of separate processes. Generally, there are two main processing systems, worsted and woolen, and another process termed short-staple or semi-worsted which is used generally in carpet production. Many wool treatment processes involve, in the following order, scouring, carding, spinning, weaving, piece dyeing and finishing (see FIG. 1). During these steps, uncontrolled shrinkage can be a problem.

Wool, in a wet state, which is submitted to any form of mechanical action including compression and relaxation undergoes a process known as felting. The phenomenon consists of individual fibers packing themselves closer and closer together, until what was originally a comparatively soft structure becomes a hard mass of interlocking fibers. This increase in density is naturally accompanied by a decrease in area or volume, commonly described as shrinkage. Felting provides both desirable and undesirable properties to wool; valuable in contexts where it is desirable to close up the texture and increase the bulkiness of the cloth (i.e., hats and jackets), but objectionable in garments which are washed frequently and for which shrinkage would make the article less desirable or unusable. Felting is generally believed to result from a directional friction effect which is connected with the structure of epithelial scales incorporated into the wool fiber itself (see e.g., E. R. Trotman, "Dyeing and Chemical Technology of Textile Fibers", 6th Ed., pp. 218 et seq., (Wiley-Interscience Publications, New York, 1984)).

In the textile industry, various treatments have been developed to reduce shrinkage. These treatments were classified in four categories by Trotman, supra, comprising: (1) modifying the scale structure of the wool fiber in such a way so as to reduce or eliminate the directional friction effect; (2) introducing intermolecular cross-links, thereby decreasing elasticity; (3) covering the fibers with a film which masks the surface, thereby removing the cause of the directional friction effect; and (4) "spot-welding" with a polymer which cements the yarn or fibers at the points of intersection, giving a rigid scaffold which imposes a severe limitation on the possibility of dimensional change. With respect to the first category, modifying the scale structure of the wool fiber, the oldest method involves applying chlorine based compounds, such as gaseous chorine, sodium hypochlorite or dichloroisocyanuric acid, to the wool surface. While it was originally believed that the success of this process was due to the breaking of disulphide bonds within the wool structure, Trotman states that this was an oversimplification of the true situation. Other fiber modification processes for wool treatment include the use of potassium permanganate in conjunction with hypochlorite at pH 11 (GB Patent No. 569,730); treating with sodium sulphate at a pH of less than 2 (known as the International Wool Secretariat process); and treating with permonosulphuric acid (generally at a pH of less than 2). Efforts to reduce shrinkage by the application of a polymer have included using hexamethylenediamine in a first stage and sebacoyl chloride in a second stage, known as the "graft polymerization method".

While these processes have been commercially accepted, there have been numerous problems with the use of currently used chemicals as wool shrink proofing agents. For example, strong acids, chlorine and chlorine based compounds are known for their difficulty as a waste product and their detrimental effect on the environment. Moreover, the use of chlorine has had the tendency to result in a less desirable wool product in terms of appearance and feel. Also, the chlorine processes have the tendency to increase the substantivity of the wool, making dye absorption rapid and resulting in difficulty in achieving level dye shades.

To overcome these difficulties in the prior art chemical based processes, the industry has looked for alternatives. One such alternative which has developed is the use of proteases to modify the scales of the wool fibers and confer resistance to felting shrinkage (see e.g., PCT Publication No. WO 96/19611; Levene et al., ISDC, vol. 112, pp. 6–10 (January 1996)). However, with some very specific exceptions, when protease is applied under conditions capable of reducing shrinkage within the limits required for machine washability, the process has resulted in significant fiber damage. Levene suggests the use of sodium sulphite at pH 8.5–9.0 prior to the application of the protease with or without an optional preliminary mild oxidation step using peroxymonosulphuric acid, dichloroisocyanuric acid or monoperoxyphthalic acid. However, none of the protease treatments disclosed was found to confer adequate shrink-resistance without causing excessive damage to the fibers. Other processes which have been suggested to reduce felting in wool include plasma treatment (see e.g., Thomas et al., Environmentally Friendly Finishing Processes for Wool by Pretreatment with Electrical Discharges in Gas (Plasma), International Textile Bulletin, vol. 2 (1993); Japanese Patent Application Tokkai Hei 4-327274) and the Delhey process wherein wool is treated with an aqueous solution of hydrogen peroxide in the presence of wolframate, optionally followed by treatment in a solution or dispersion of synthetic polymers.

Peroxidases and oxidases have been suggested for use in the treatment of textiles for bleaching, dye transfer inhibition or to remove excess dye from new textiles (EP Publication No. 0 495 836; PCT Publication Nos. WO 92/18683 and WO 92/18687) and as an additive to detergent for bleaching stains (PCT Publication No. 89/09813).

PCT Publication Nos. WO 96/12845 and 96/12846 disclose processes for providing a bleached look in the colour density of the surface of dyed fabrics, particularly cellulosic fabrics such as denim, comprising using a phenol oxidizing enzyme such as a peroxidase or a laccase and an enhancing agent.

While significant progress has been achieved with the use of chemicals in the wool industry to prevent shrinkage, as described above, the need remains for an environmentally benign, effective and safe method of conferring shrink-resistance to wool.

SUMMARY OF THE INVENTION

It is an object of the invention to provide for an alternative method of conferring shrink resistance to wool and wool based fabrics, yarns, fibers and articles made thereof.

It is a further object of the invention to provide for a method of conferring shrink resistance to wool and wool based fabrics, yarns, fibers and articles made thereof which avoids the use of toxic, unsafe or environmentally undesirable chemicals or processes.

It is yet a further object of the invention to provide for an alternative process step during the processing of wool fibers, which alternative process step replaces a step during which conditions conducive to excessive wool shrinkage occur.

According to the present invention, a method for reducing the shrinkage of wool is provided comprising the steps of: (a) preparing an aqueous solution comprising an oxidase or a peroxidase; and (b) contacting a wool containing article with the aqueous solution under conditions suitable for reacting the oxidase or peroxidase with the wool. Preferably, steps (a) and (b) are performed prior to or during subjecting the wool to shrinkage conditions. Optional results can be achieved where a mediator is used to enhance enzyme activity. Further preferably, steps (a) and (b) are performed prior to or during the application of a dye.

In a composition embodiment of the invention, a woolen article is provided which has been treated in accordance with a method embodiment of the invention so that such wool product has a reduced capability to shrink.

The present invention provides several important advantages when compared to methods in the prior art. For example, one advantage is that the methods according to the present invention do not require the use of environmentally deleterious chemicals, for example chlorine, in either the quality or quantity of such use in the prior art. Yet another advantage of the present invention is that fabric degradation such as that seen with the use of proteases is avoided. The object and attendant advantages of the present invention will be made more in the following detailed description and examples.

DETAILED DESCRIPTION OF THE INVENTION

Figure 1:
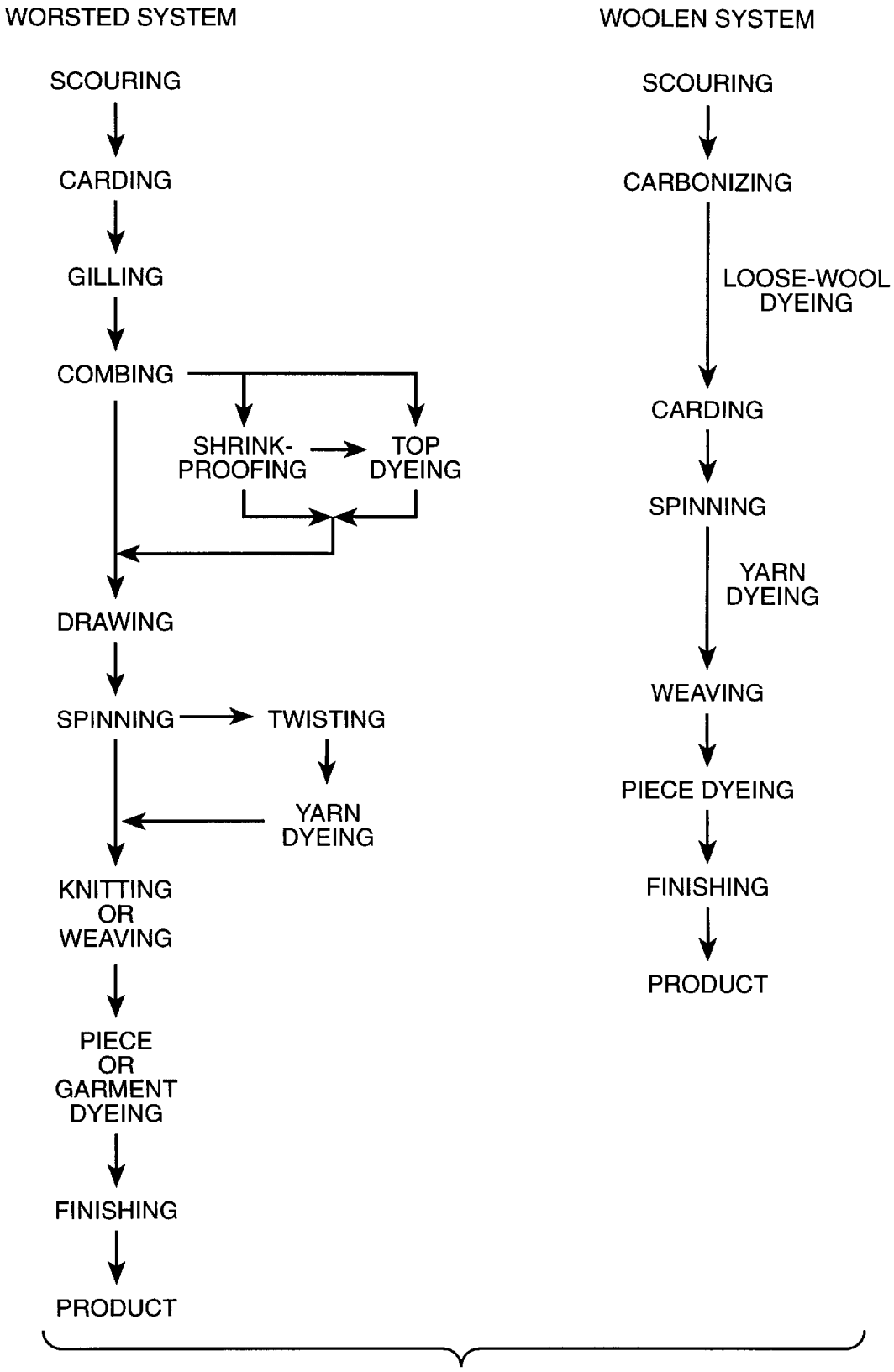
FIG. 1 illustrates typical wool processing sequences used in industry.

"Shrink-reduction" means a reduction in the ability of a wool or wool containing material to shrink when processed under conditions conducive to shrinkage. Shrink reduction properties according to the present invention refer to a quality of wool or wool containing material processed according to the invention and treated under conditions conducive to shrinkages and which generally causes shrinkage, but wherein less shrinkage is observed compared to a similar wool or wool containing material which has not been so treated under certain conditions.

"Wool or wool containing material" means any animal hair product which is or is intended to be woven or processed into a textile garment or wool containing article, e.g., rugs, hats, etc. Thus, wool from sheep, camel, rabbit, goat, llama wools, and thus, merino wool, shetland wool, cashmere wool, alpaca wool or mohair are encompassed within the present invention. Wool which may be processed according to the present invention includes wool top, fiber, yarn, or woven or knitted fabric. Wool containing compositions may comprise other non-wool components, for example polyester/wool blends.

"Shrinkage conditions" mean those conditions which cause wool or wool containing material to shrink. Conditions known to confer felting shrinkage are discussed in detail in Makinson, K., "Shrinkproofing of Wool", Marcel Dekker Inc., New York (1979), pp. 180, et seq.; Moncrief, R., "Wool Shrinkage and its Prevention", The National Trade Press Ltd., London (1953) pp. 113–169, et seq. which discussions are herein incorporated by reference. Specifically, the presence of water is known to increase felting, particularly in conjunction with mechanical agitation. Temperature is also known to affect felting, and it is generally believed that between the temperatures of 20–60° C., the feltability of a wool article will generally increase, although at higher temperatures, felting is still a major problem. pH appears to affect shrinkage, with some researchers showing maximum felting at a pH of 10, but in any event, both acid and alkali are believed to induce felting. The presence of detergents (soap) has also been shown to increase felting in alkaline or neutral media. The presence of neutral salts (e.g., NaCl), lubricants (e.g., oils, waxes and greases or other substances which may decrease the coefficient of withscale friction), alcohol, agitation (e.g., in washing machines) may also increase felting of wool. While each of the above environmental factors has an impact on feltability of wool, and may have a critical level at which a certain type of wool will felt, it is equally important to consider their combined effects. Thus, the use of a detergent in a washing machine at 50° C. under conditions of moderate agitation would be likely to produce felting in a wool article which had not been extensively shrinkproofed. Nonetheless, due to differences in specific wools and pre-processing steps taken prior to shrink-proofing, it is not generally possible to always specifically predict or identify conditions which will cause shrinkage. In any event, it is a simple matter for the skilled worker to determine whether specific conditions in a wool processing step or steps are conducive to shrinkage of a specific wool. That worker need only subject the wool article to the specific conditions and measure the shrinkage which results. Accordingly, while the above list of factors is not all-inclusive of shrinkage conditions, that scope of shrinkage conditions is most appropriately determined by measuring whether shrinkage occurs with a wool article under a specific set of conditions.

"Conventional shrink reduction processes" means those processes presently known in the industry to produce wool products which have a lessened tendency to shrink under shrinkage conditions. For example, methods for reducing the tendency of wool to shrink include processes based on treatment with hot alcohol and ammonium thioglycolate, sodium hydroxide, benzoquinone, mercury acetate, aryl monoisocyanates, chlorine, dichloroisocyanuric acid, permanganate, permonosulphuric acid and polymer films such as Zeset TP, Hercosett 57, Primal K3, DC-109, Oligan 500, Synthappret LKF or Synthappret BAP.

"Chlorine based shrink reducing agents" means those conventional shrink reduction processes which utilize chlorine based chemicals for the purpose of shrink proofing. Commonly used chlorine based shrink reducing agents include chlorine gas, hypochlorite and dichloroisocyanuric acid.

"Oxidoreductase" enzyme means any enzyme which catalyzes an oxidation or reduction reaction or reactions with respect to a specific substrate(s). Particularly useful in the present invention are oxidoreductase enzymes which use hydrogen peroxide (peroxidases) or molecular oxygen (oxidases) to oxidize a substrate. Preferred peroxidases are those derived from plants (horseradish peroxidase) or microorganisms (e.g., manganese peroxidase or microperoxidase from *Bacillus pumilus*). Examples of suitable peroxidases are those comprising EC 1.11.1.7 which are derived from animals, plants, or microorganisms such as fungi or bacteria. Preferred oxidases are laccase, catechol oxidase, bilirubin oxidase and monophenol monooxygenase enzymes. Examples of suitable laccases are those comprising EC 1.10.3.2 which are derived from animals, plants, or microorganisms. Peroxidases and/or oxidases suitable for the present invention may be derived from many organisms, including those derived from the taxonomic groups Zygomycetes, Deuteromycetes, Ascomycetes, Basidiomycetes and the Hyphomycetes. Particular species from which appropriate peroxidases and/or oxidases may be derived include Aspergillus spp.; Rhizoctonia spp.; Gliocladium spp.; Sordaria spp.; Hypoxylon spp.; Zalerion spp.; Gongronella spp.; Aigialus spp.; Lophiostoma spp.; Halosarpheia spp.; Quintaria spp.; Cirrenalia spp.; Fusarium spp., including *F. oxysporum*; Humicola spp., including *H. insolens*; Trichoderma spp., including *T. reesei, T. longibrachiatum*; Myrothecium spp., including *M. verrucana; Verticillum spp.*, including *V. alboatrum, V. dahlie*; Arthromyces spp., including *A ramosus*; Caldariomyces spp., including *C. fumago*; Ulocladium spp., including *U. chartarum*; Embellisia spp., including *E. alli*; Cladosporium spp.; Coprinus spp. including *C. cinerus, C. macrorhizus*; Phanerochaete spp. including *P. chrysosporium*; Coriolus spp.; Trametes spp. including *T. versicolor*; Rhizopus spp.; Mucor spp. including *M. hiemalis*; Streptomyces spp. including *S. spheroides, S. thermoviolacelus*; Streptoverticillum spp., including *S. verticillium*; Bacillus spp. including *B. pumilus, B. stearothermophilus*; Rhodobactersphaeroides spp.; Rhodomonas spp. including *R. palustri*; Streptococcus spp. including *S. lactis*; Pseudomonas spp. including *P. fluroescens, P. purrocinia*; Myxococcus spp. including *M. virescens*; and Dreschlera spp. including *D. halodes*. In a particularly preferred embodiment of the invention, the laccase is derived from Trametes spp., particularly *Trametes versicolor*, or Pleurotus spp., particularly *Pleurotus ostreatus*.

In connection with the use of oxidoreductases such as peroxidases and laccases, it is known that certain chemicals will act as an "accelerator" or "mediator" facilitating enhanced reactivity of the enzyme with a desired substrate or substrates. Such mediators include ABTS, HOBT, 1-nitroso-2-naphthol-3,6-disufonic acid, and compounds described in, for example, PCT Publication Nos. 92/20857, 92/09741, 94/29510, 94/12621, 94/12620, 94/12619, 95/01426 and European Patent Application Publication Nos. 0 447 672, 0 447 673, which disclosures are herein incorporated by reference. Applicants have discovered that the use of a mediator in connection with the present invention will often facilitate or improve results obtained. Additionally, dyes are known to act as mediators with oxidases and peroxidases. Accordingly, it may be possible to treat wool according to the present invention simultaneously with dyeing, with the dye serving the dual purpose of adding color to the fabric and acting as a mediator for the oxidoreductase reaction. Nonetheless, the process is preferably performed prior to the application of a dye. As described in PCT Publication Nos. WO 92/18683 and WO 92/18687, it is known that some oxidoreductases will effect dye adhered to or being applied to textile. Accordingly, to ensure that the dye remains in a desirable condition, the process described herein should preferably be practiced prior to the application of the dye.

"Dyeing" means the process of altering the color of a wool article during its manufacture to confer a color desirable to the consumer. Dyeing comprises contacting the wool article with a specific dye composition for the purpose of changing its color pursuant to any of the many processes and/or compositions well known in the art.

According to the present invention, a method for reducing the shrinkage of wool is provided comprising the steps of: (a) preparing an aqueous solution comprising an oxidoreductase enzyme; and (b) contacting a wool containing article with said aqueous solution under conditions suitable for reacting said oxidoreductase enzyme with said wool. Preferably, steps (a) and (b) are performed prior to subjecting said wool to shrinkage conditions. Further preferably, the steps (a) and (b) are carried out prior to the application of a dye.

It is contemplated that the present invention may be incorporated into wellknown wool processing methods. In connection with the herein described process, the oxidoreductase enzyme should be placed in the aqueous solution in such a manner to ensure that sufficient activity is present. A suitable amount of enzyme would be from about 1.0 to 50 mg/L or an activity would be from about 100 ABTS u/L to 4000 ABTS u/L. Appropriate pH, temperature and environmental constituents (e.g., salts, buffers, stabilizing agents) should be determined with reference to the utilized enzyme. With respect to laccase from *Trametes versicolor*, the appropriate pH is from about 3 to 6; and the appropriate temperature from about 25° C. to 70° C.

The contacting step should be carried out for a time and under conditions to ensure that the oxidoreductase enzyme has sufficient opportunity to react with the wool. While the time necessary for reaction will vary based on the activity level of the enzyme, the temperature, pH and other environmental factors, it has been determined by the inventors herein that a time of reaction under appropriate conditions given the enzyme of use will be from 2 minutes to 48 hours, preferably from about 15 minutes to 10 hours and most preferably from about 30 minutes to 3 hours. Additionally, in practicing the present invention described herein, it has been found that contacting the oxidoreductase enzyme with the wool or wool containing material under at least moderate agitation provides an exceptional shrink-proofing benefit. Agitation as described herein may be conferred by any number of means, including for example, commercial washing machines (e.g., tunnel washers, home use washing machines, e.g., agitator, drum or pulse machines), or techniques commonly used in textile processing to confer agitation, (e.g., mercerizing, jet usage or other techniques in common industrial use). "At least moderate agitation" means a level of agitation under a given set of circumstances that results in at least 5% shrinkage, preferably at least 8% shrinkage and most preferably 15% shrinkage of a given wool or wool containing material in the absence of utilizing the invention described herein.

In practicing the present invention, it is preferred that the process be performed at a step prior to or during a step wherein the wool is subjected to shrinkage conditions. For example, if during the processing of wool it is determined that a specific step is especially conducive to causing shrinkage, the wool should be treated prior to or during that step according to the process described herein to help prevent or reduce the level of shrinkage experienced during that step. Preferably, the process according to the present invention is performed prior to or during a period of moderate or high agitation, i.e., laundering or other mechanical distress applied to the fabric.

The following examples are provided as illustrative of the invention described herein and is not be considered limiting as it is the claims which describe the proper scope of the invention.

EXAMPLES

Example 1

Shrinkage Reduction in Wool Treated with Laccase from *Trametes versicolor*

(A) Scoured wool flannel swatches were treated in the Terg-O-Tometer at agitation speed of 100 RPM under the following conditions. After the treatment, all the swatches were rinsed in a home washer and then air dried flat on the table.

Experimental Conditions
Equipment: Terg-O-Tometer
Speed of Agitation: 100 RPM
Treatment temperature: 50° C.
Treatment pH: 4.5 (50 mM Acetate Buffer) for *Trametes versicolor*
Treatment time: 3 hours
Liquor ratio: 63 to 1
Materials
Laccase: *Trametes versicolor* ≃ 1500 units/L
Mediator:
HOBT: 1-Hydroxy-Benzotriazole
Substrates: scoured wool flannel (purchased from Test Fabrics # 538) original swatch size—3 inches by 3 inches Laccase activity was measured in ABTS units ad described in Bourbonnais et al., Appl. Env. Microb., Vol. 61, No. 5 (1995) as follows:

Enzyme assays. Laccase activity was determined by oxidation of ABTS. The assay mixture contained 0.5 mM ABTS, 0.1 M sodium acetate (pH 5.0), and a suitable amount of enzyme. Oxidation of ABTS was monitored by determining the increase in $A_{420}$ ($\epsilon_{420}$, $3.6\times10^4$ $M^{-1}\cdot cm^{-1}$). Enzyme activity was expressed in units defined as follows: 1 U=1 $\mu$mol of ABTS oxidized per min.

Measurement of % Shrinkage

The size of the fabric swatches were measured in both length and width direction before and after the treatment. The percentage shrinkage was determined by the difference of added dimensions (the length plus the width) before the treatment, and after the treatment divided by the added dimensions (the length plus the width) before the treatment, the quotient multiplied by 100. The results are shown in Table 1.

TABLE 1

| Code | Enzyme | Mediator | Buffer | pH | Size (width + length) [inches] | (%) shrinkage |
|---|---|---|---|---|---|---|
| Original | N/A | N/A | N/A | N/A | 6.00 <0.00> | 0.00 <0.00> |
| 1 | None | None | Acetate (50 mM) | 4.5 | 4.83 <0.16> | 19.44 <2.62> |
| 2 | None | HOBT (0.39 g) | Acetate (50 mM) | 4.5 | 3.29 <0.04> | 45.15 <0.59> |
| 3 | Trametes Versicolor (1500 units) | HOBT (0.39 g) | Acetate (50 mM) | 4.5 | 5.35 <0.00> | 11.46 <0.00> |

< >: standard deviation

As shown in Table 1, wool treated with laccase from *Trametes versicolor* and HOBT resulted in significantly lower shrinkage than treatment with HOBT alone or no treatment.

(B) *Trametes versicolor* laccase with two different mediators (ABTS and HOBT) as well as *Trametes versicolor* alone were tested for their effect on shrinkage of wool.

Experimental Conditions
Equipment: Terg-O-Tometer
Speed of Agitation: 100 RPM
Treatment temperature: 48° C.
Treatment pH: 4.5 (50 mM Acetate Buffer)
Treatment time: 3 hours
Liquor ratio: 43 to 1
Materials
Laccase: *Trametes versicolor* ≃ 1500 units/L
Mediators:
ABTS: 2,2'-Azino-bis (3-Ethylbenz thiazoline-6-sulfonic acid)
HOBT: 1-Hydroxy Benzotriazole Substrate:

Scoured 100% wool flannel (Test Fabrics # 538)

Results are shown in Table 2.

TABLE 2

| Code | Enzyme | Mediator | Buffer | pH | Size (width + length) [inches] | (%) shrinkage |
|---|---|---|---|---|---|---|
| Original | N/A | N/A | N/A | N/A | 8.00 <0.00> | 0.00 <0.00> |
| 1 | None | None | Acetate (50 mM) | 4.5 | 6.00 <0.09> | 25.00 <1.10> |
| 2 | None | ABTS (0.17 g) | Acetate (50 mM) | 4.5 | 6.16 <0.04> | 23.05 <0.55> |
| 3 | Trametes Versicolor (1500 units) | ABTS (0.17 g) | Acetate (50 mM) | 4.5 | 6.25 <0.00> | 21.87 <0.00> |
| 4 | None | HOBT (0.17 g) | Acetate (50 mM) | 4.5 | 5.72 <0.04> | 28.51 <0.55> |
| 5 | Trametes Versicolor (1500 units) | HOBT (0.17 g) | Acetate (50 mM) | 4.5 | 6.66 <0.13> | 16.79 <1.65> |
| 6 | Trametes Versicolor (1500 units) | None | Acetate (50 mM) | 4.5 | 6.13 <0.00> | 23.44 <0.00> |

< >: standard deviation

As shown in Table 2, the *Trametes versicolor* laccase/HOBT system showed significantly lower fabric shrinkage than any system without laccase. Additionally, laccase in the absence of mediator showed significantly lower fabric shrinkage compared to any system without laccase.

Example 2

Treatment of Wool With Laccase/Mediator Under Low Acgitation

In this Example, mechanical action was reduced by lowering the agitation speed from 100 RPM to 30 RPM during the treatment step. After the experiments all the samples were laundered multiple times to verify the effect of laccase treatment on antifelting.

Experimental Conditions

Equipment: Terg-O-Tometer

Agitation speed: 30 RPM

Treatment temperature: 40° C.

Treatment pH: 4.5 (50 mM Acetate Buffer)

Treatment time: 3 hours

Liquor ratio: 40 to 1

Materials

Laccase: *Trametes versicolor* ≃ 1500 units/L

Mediator:

ABTS: 2,2'-Azino-bis (3-Ethylbenz Thiazoline-6-Sulfonic acid)

HOBT: 1-Hydroxy Benzotriazole

Substrates:

Scoured 100% wool flannel (Test Fabrics # 538)

Shrinkage was measured as in Example 1. Results are shown in Table 3.

TABLE 3

| Code | Enzyme | Mediator | Buffer | pH | Size (width + length) [inches] | (%) shrinkage |
|---|---|---|---|---|---|---|
| Original | N/A | N/A | N/A | N/A | 6.00 <0.00> | 0.00 <0.00> |
| 1 | None | None | Acetate (50 mM) | 4.5 | 5.80 <0.02> | 3.35 <0.35> |
| 2 | None | HOBT (0.4 g) | Acetate (50 mM) | 4.5 | 5.81 <0.04> | 3.12 <0.00> |
| 3 | Trametes Versicolor (1500 units) | HOBT (0.4 g) | Acetate (50 mM) | 4.5 | 5.81 <0.00> | 3.12 <0.00> |
| 4 | None | ABTS (0.4 g) | Acetate (50 mM) | 4.5 | 5.78 <0.04> | 3.64 <0.74> |
| 5 | Trametes Versicolor (1500 units) | ABTS (0.17 g) | Acetate (50 mM) | 4.5 | 5.80 <0.02> | 3.37 <0.37> |

< >: standard deviation

As shown in Table 3, under the conditions set in this Example, all the samples resulted in very small rate of dimensional change.

Example 3

Treatment of Wool with Laccase and Mediator in the Presence of Surfactant

In this Example, *Trametes versicolor* laccase at a higher dosage than in previous experiments was tested to confirm the previous results.

Experimental Conditions
Equipment: Terg-O-Tometer
Speed of Agitation: 100 RPM
Treatment temperature: 50° C.
Treatment pH: *Trametes versicolor* pH 4.5 (50 mM Acetate Buffer)
Treatment time: 3 hours
Liquor ratio: 78 to 1
Wetting agent: non-ionic surfactant (1% Triton X-100) ≃ 1 mL/L
Materials
Laccase: *Trametes versicolor* @ 1500 units/L
Mediator:
ABTS: 2,2'-Azino-bis (3-Ethylbenz Thiazoline-6-Sulfonic acid)
HOBT: 1-Hydroxy Benzotriazole
Substrates: Scoured 100% wool flannel (Test Fabrics # 538)
Shrinkage was measured as in Example 1. Results are shown in Table 4.

TABLE 4

| Code | Enzyme | Mediator | Buffer | pH | Size (width + length) [inches] | (%) shrinkage |
|---|---|---|---|---|---|---|
| Original | N/A | N/A | N/A | N/A | 10.00 <0.00> | 0.00 <0.00> |
| 1 | None | None | Acetate (50 mM) | 4.5 | 7.83 <0.04> | 21.67 <0.36> |
| 2 | Trametes Versicolor (2000 units) | None | Acetate (50 mM) | 4.5 | 8.21 <0.10> | 17.92 <0.95> |
| 3 | None | HOBT (0.4 g) | Acetate (50 mM) | 4.5 | 7.25 <0.11> | 27.50 <1.08> |
| 4 | Trametes Versicolor (2000 units) | HOBT (0.4 g) | Acetate (50 mM) | 4.5 | 8.33 <0.04> | 16.67 <0.36> |
| 5 | None | ABTS (0.4 g) | Acetate (50 mM) | 4.5 | 7.27 <0.04> | 27.29 <0.36> |
| 6 | Trametes Versicolor 2000 units | ABTS (0.4 g) | Acetate (50 mM) | 4.5 | 7.60 <0.16> | 23.96 <1.57> |

< >: standard deviation

*Trametes versicolor* with HOBT system showed the lowest amount of felting shrinkage rate. Trametes versicolor-treatment alone without mediator showed reduction of felting shrinkage during the treatment.

I claim:

1. A method for the reducing shrinkage of wool consisting essentially of the steps of:

(a) preparing an aqueous solution consisting essentially of an oxidase or a peroxidase, optionally in the presence of a mediator; and (b) contacting a wool containing article with said aqueous solution under conditions suitable for reacting said oxidase or peroxidase with said wool.

2. The method according to claim 1, wherein said steps (a) and (b) are performed prior to or during subjecting said wool to shrinkage conditions.

3. The method according to claim 1, wherein subsequent to said method, said wool containing article is treated under shrinkage conditions.

4. The method according to claim 3, wherein said shrinkage conditions consist essentially of washing said wool under conditions which include agitation.

5. The method according to claim 1, wherein said peroxidase or oxidase is derived from an organism selected from the group consisting of Fusarium spp., Humicola spp., Trichoderma spp., Myrothecium spp., Verticillum spp., Arthromyces spp., Caldariomyces spp., Ulocladium spp., Embellisia spp., Cladosporium spp., Coprinus spp., Phanerochaete spp., Coriolus spp., Trametes spp., Rhizopus spp., Mucor spp., Streptomyces spp., Streptoverticillum spp., Bacillus spp., Rhodobactersphaeroides spp., Rhodomonas spp., Streptococcus spp., Pseudomonas spp., Myxococcus spp., and Dreschlera spp.

6. The method according to claim 1, wherein said peroxidase or oxidase consists essentially of a laccase.

7. The method according to claim 6, wherein said laccase is derived from Trametes spp. or Pleurotus spp.

8. The method according to claim 7, wherein said laccase is derived from *Trametes versicolor*.

9. The method according to claim 1, wherein said oxidase or peroxidase is contacted with said wool containing article prior to or during the application of a dye.

10. The method according to claim 1, wherein said aqueous solution consists essentially of an oxidase or peroxidase and an accelerator.

11. The method according to any of claims 1 or 2, wherein said step (b) is performed under conditions consisting essentially of at least moderate agitation of the wool.

12. A wool fabric, garment or fiber treated according to the process of claim 1.

* * * * *